United States Patent [19]

Ona et al.

[11] Patent Number: 4,857,212

[45] Date of Patent: Aug. 15, 1989

[54] FIBER-TREATING COMPOSITION COMPRISING MICROEMULSION OF CARBOXY-SUBSTITUTED SILOXANE POLYMER AND USE THEREOF

[75] Inventors: Isao Ona; Masaru Ozaki, both of Chiba, Japan

[73] Assignee: Toray Silicone Co., Ltd., Tokyo, Japan

[21] Appl. No.: 184,320

[22] Filed: Apr. 21, 1988

[30] Foreign Application Priority Data

Apr. 24, 1987 [JP] Japan ..... 62-101637

[51] Int. Cl.[4] ..... D06M 15/63

[52] U.S. Cl. ..... 252/8.6; 106/287.12; 106/287.13; 427/387; 428/391

[58] Field of Search ..... 252/8.6, 174.15; 528/26, 41; 428/365, 391; 106/287.13; 427/387

[56] References Cited

U.S. PATENT DOCUMENTS

| | | | |
|---|---|---|---|
| 3,812,201 | 5/1974 | Bey | 528/41 |
| 4,064,057 | 12/1977 | Koerner et al. | 252/8.6 |
| 4,139,546 | 2/1979 | Berger et al. | 252/174.15 |
| 4,477,514 | 10/1984 | Gee et al. | 428/264 |
| 4,501,619 | 2/1985 | Gee | 106/287.12 |
| 4,541,936 | 9/1985 | Ona et al. | 252/174.15 |
| 4,620,878 | 11/1986 | Gee | 106/287.15 |
| 4,624,676 | 11/1986 | White et al. | 252/8.6 |

FOREIGN PATENT DOCUMENTS

| | | | |
|---|---|---|---|
| 601840 | 7/1960 | Canada | 528/41 |
| 1101766 | 12/1954 | Fed. Rep. of Germany | 528/41 |

*Primary Examiner*—Prince E. Willis
*Assistant Examiner*—Susan Franklin
*Attorney, Agent, or Firm*—George A. Grindahl

[57] ABSTRACT

A fiber-treatment composition based on a microemulsion, having an average particle size not larger than 0.15 micrometers, of a carboxyl-modified organopolysiloxane having a degree of polymerization of form 350 to 2000 and having at least two carboxyl groups in each molecule is characterized by an excellent mechanical stability, dilution stability, and blending stability, and can impart a durable softness, smoothness, wrinkle resistance, and compression recovery to fibrous material without the occurrence of oil spotting. Further stability of the microemulsion can be realized by adding a basic material to the microemulsion to adjust the pH of the microemulsion, preferably to a value of from 6.5 to 9.0.

6 Claims, No Drawings

FIBER-TREATING COMPOSITION COMPRISING MICROEMULSION OF CARBOXY-SUBSTITUTED SILOXANE POLYMER AND USE THEREOF

BACKGROUND OF THE INVENTION

The present invention relates to a fiber-treatment composition which is based on a microemulsion of carboxyl-modified organopolysiloxane, and more specifically relates to a fiber-treatment composition which is based on a microemulsion, said microemulsion having an average particle size not larger than 0.15 micrometers, of a carboxyl-modified organopolysiloxane which has a degree of polymerization of 350 to 2,000 and which contains at least two carboxyl groups in each molecule.

Emulsions having an average particle size of at least 0.3 micrometers, and prepared by the emulsification of carboxyl-modified organopolysiloxane in the presence of at least one type of anionic or nonionic surfactant using an emulsifying device such as, for example, an homogenizer, colloid mill, line mixer or propeller mixer, are used in the art in order to impart softness, smoothness, wrinkle resistance, elongation recovery, water repellency, etc., to fibrous materials of, for example, natural fiber such as cotton, flax, silk, wool, angora or mohair; regenerated fiber such as rayon or bemberg; semisynthetic fiber such as acetate; synthetic fiber such as polyester, polyamide, polyacrylonitrile, polyvinyl chloride, vinylon, polyethylene, polypropylene, spandex; or inorganic fiber such as glass fiber, carbon fiber or silicon carbide fiber. Refer to Japanese patent application laid open (Kokai) No. 55-152864 (152,864/80).

However, the aforesaid carboxyl-modified organopolysiloxane emulsions having average particle sizes of at least 0.3 micrometers suffer from a number of serious problems. Their stability during the agitation, circulation, and expression of the treatment bath which are necessarily encountered during fiber treatment (mechanical stability); their stability when diluted (dilution stability, for example, 20-fold to 100-fold dilution with water); and their stability when used with various additives (blending stability) are all unsatisfactory. These emulsions undergo de-emulsification as a consequence, and the organopolysiloxane floats up on the treatment bath and in this state will stain the fibrous material as oil droplets (oil spots).

BRIEF SUMMARY OF THE INVENTION

The present invention has as its object the elimination of the above problems by providing a fiber-treatment composition which has an excellent emulsion stability (mechanical, dilution, and blending) and which also imparts a durable softness, smoothness, wrinkle resistance, and compression recovery to fibrous materials without the generation of oil spots.

Because the fiber-treatment composition of the present invention is based on a microemulsion (average particle size not larger than 0.15 micrometers) of carboxyl-modified organopolysiloxane it is characterized by an excellent mechanical stability, dilution stability, and blending stability, and can impart a durable softness, smoothness, wrinkle resistance, and compression recovery to fibrous material without the occurrence of oil spotting. As a consequence, it is quite useful in the art.

DETAILED DESCRIPTION OF THE INVENTION

The present invention relates to a fiber-treatment composition comprising a microemulsion of a carboxyl-modified organopolysiloxane having the general formula $$A(R_2SiO)_x(RASiO)_yR_2SiA$$

wherein R is a monovalent hydrocarbon group, A is R or a carboxyl group having the formula $R^1COOH$, $R^1$ is a divalent organic group, $X=0$ to 2,000 $y=0$ to 200, and $X+y=350$ to 2,000 and having at least two $R^1COOH$ groups in each molecule, said microemulsion having an average particle size not larger than 0.15 micrometers.

The present invention further relates to a method for treating fiber, and to treated fibers prepared by said method, said method comprising (a) applying the fiber-treatment composition to the fiber and (b) drying the treated fiber.

To explain the preceding, the carboxyl-modified organopolysiloxane used in the present invention has the general formula $A(R_2SiO)_x(RASiO)_yR_2SiA$, and functions to impart a durable softness, smoothness, wrinkle resistance, and compression recovery to the fibrous material.

R in the above formula is to be a monovalent hydrocarbon group, and is exemplified by alkyl groups such as methyl, ethyl, propyl, and octyl; alkenyl groups such as vinyl, allyl, and propenyl; substituted alkyl groups such as 2-phenylethyl, 2-phenylpropyl, and 3,3,3-trifluoropropyl; and aryl and substituted aryl groups such as phenyl and tolyl.

A is to be an R group or a $R^1COOH$ group. Here, $R^1$ is a divalent organic group, and is exemplified by alkylene groups such as $—CH_2—$, $—CH_2CH_2—$, $—CH_2CH_2CH_2—$, $—CH_2CH_2CH_2CH_2—$, and $—CH_2CH(CH_3)CH_2—$; alkylenearylene groups such as $—(CH_2)_2C_6H_4—$; and sulfur-containing alkylene groups such as $—CH_2S—$, $—CH_2CH_2S—$, $—CH_2CH_2SCH_2—$, $—CH_2CH_2CH_2SCH_2—$, and $—CH_2CH(CH_3)CH_2S—$.

In the above formula x has an average value of from 0 to 2,000, y has an average value of from 0 to 200, and x+y has an average value of from 350 to 2,000. Furthermore, this organopolysiloxane must contain in each molecule at least 2 carboxyl groups as expressed by $R^1COOH$. When x+y is less than 350, the softness, smoothness, wrinkle resistance, and compression recovery imparted to the fibrous material will be unsatisfactory, while emulsification becomes problematic when x+y exceeds 2,000.

It is preferred that x be 0 to 1,000, that y be 0 to 100, and that x+y be 380 to 1,000. At least 2 carboxyl groups $R^1COOH$ must be present in order to provide durability. Preferably no more than 10% of all A groups plus R groups are carboxyl groups.

The fiber-treatment composition of the present invention is based on a microemulsion of said carboxyl-modified organopolysiloxane which has an average particle size not larger than 0.15 micrometers. At average particle sizes in excess of 0.15 micrometers, one encounters a reduced mechanical stability, dilution stability, and blending stability, and as a consequence, oils spots will be generated on the fibrous material during long-term treatment processes. It is preferred that the average particle size not exceed 0.12 micrometers.

The instant microemulsion is produced, for example, by the mechanical emulsification of (A) 100 weight parts carboxyl-modified organopolysiloxane having the general formula $$A(R_2SiO)_x(RASiO)_yR_2SiA$$

wherein R is a monovalent hydrocarbon group, A is R or $R^1COOH$, $R^1$ is a divalent organic group, x=0 to 2,000, y=0 to 200, and x+y=350 to 2,000 and having at least two $R^1COOH$ groups in each molecule, in water in the presence of (B) 15 to 60 weight parts nonionic surfactant and/or anionic surfactant.

The nonionic and/or anionic surfactant comprising component (B) is required for the microemulsification of said carboxyl-modified organopolysiloxane.

Here, the nonionic surfactants are concretely exemplified by the polyoxyalkylene alkyl ethers, the polyoxyalkylene alkylphenol ethers, the polyoxyalkylene alkyl esters, the polyoxyalkylene sorbitan alkyl esters, the polyethylene glycols, the polypropylene glycols, and diethylene glycol.

Said anionic surfactants are concretely exemplified by alkylbenzenesulfonic acids, for example, hexylbenzenesulfonic acid, octylbenzenesulfonic acid, decylbenzenesulfonic acid, dodecylbenzenesulfonic acid, cetylbenzenesulfonic acid, and myristylbenzenesulfonic acid; the sulfate esters of polyoxyethylene monoalkyl ethers, for example, $$CH_3(CH_2)_6CH_2O(C_2H_4O)_2SO_3H,$$

$$CH_3(CH_2)_8CH_2O(C_2H_4O)_8SO_3H,$$

$$CH_3(CH_2)_{19}CH_2O(C_2H_4O)_4SO_3H,$$

and $$CH_3(CH_2)_8CH_2C_6H_4O(C_2H_4O)_2SO_3H;$$

and by alkylnaphthylsulfonic acids.

The surfactant comprising component (B) is to be used at 15 to 60 weight parts per 100 weight parts carboxyl-modified organopolysiloxane comprising component (A). At less than 15 weight parts, the microemulsion will not reach 0.15 micrometers or less. For example, referring to the emulsion described in Example 3 of Japanese patent application laid open (Kokai) No. 55-152864 (152,864/80), the average particle size in the emulsion at best reaches only 0.5 to 2.0 micrometers with the use of 11.1 weight parts emulsifying composition per 100 weight parts carboxyl-modified organopolysiloxane. The use of 20 to 40 weight parts component (B) is preferred.

No specific restriction is placed on the quantity of water necessary for the emulsification of the carboxyl-modified organopolysiloxane, but water is preferably used in such a quantity that the organopolysiloxane concentration reaches 10 to 40 wt%.

The microemulsion used in the present invention having an average particle size not larger than 0.15 micrometers is prepared by mixing the above-mentioned carboxyl-modified organopolysiloxane comprising component (A) plus the nonionic and/or anionic surfactant comprising component (B) plus water to homogeneity, and by then emulsifying this in an emulsifying device such as an homogenizer, colloid mill, line mixer, propeller mixer, vacuum emulsifier, etc.

An even more stable microemulsion can be prepared by adjusting the pH of the resulting microemulsion to approximately 6.5 to 9.0 using a base such as sodium hydroxide, potassium hydroxide, sodium carbonate, potassium carbonate, amine, etc.

As desired, additional water; resin finishing agents such as glyoxal resin, melamine resin, urea resin, polyester resin, or acrylic resin; organohydrogenpolysiloxane; organoalkoxysilane; surfactant; preservative; colorant; etc., may be added to the fiber-treatment composition of the present invention.

Fibrous material is treated by applying the fiber-treatment composition of the present invention to the material by any method such as spraying, roll application, brush coating, immersion, etc. The add-on quantity will vary with the type of fibrous material and so may not be rigorously specified, but generally falls within the range of 0.01 to 10.0 wt% as organopolysiloxane fraction. The fibrous material is then dried by alllowing it to stand at room temperature, or blowing it with hot air, or heating it, etc.

In its substance, the fibrous material can be, for example, a natural fiber such as hair, wool, silk, flax, cotton, angora, mohair, or asbestos; regenerated fiber such as rayon or bemberg; semisynthetic fiber such as polyester, polyamide, polyacrylonitrile, polyvinyl chloride, vinylon, polyethylene, polypropylene, or spandex; or inorganic fiber such as glass fiber, carbon fiber, or silicon carbide fiber.

The fibrous material can take the form of, for example, the staple, filament, tow, top, or yarn, and can have a structure of, for example, a knit, weave, nonwoven, or paper.

The invention will be further explained, but not limited, by the following illustrative examples. In the examples, parts=weight parts, and the viscosity was measured at 25 degrees Centigrade. Me denotes the methyl group.

EXAMPLE 1

Thirty parts organopolysiloxane with a viscosity of 1,850 centistokes and having the formula $$Me_3SiO(\underset{\underset{C_{10}H_{21}COOH}{|}}{MeSiO})_8(ME_2SiO)_{400}SiMe_3$$

were mixed to homogeneity with 6 parts polyoxyethylene (6 mol EO) trimethylnonanol ether and 2 parts polyoxyethylene (7 mol EO) lauryl ether using a propeller stirrer. Six parts water were then added, followed by stirring at 350 rpm for 10 minutes, the addition of another 65.6 parts water, and stirring at the same rate as before for 30 minutes to achieve emulsification. The pH was adjusted to 8.0 by the addition of 0.4 parts sodium carbonate. The product was a slightly white, transparent microemulsion (Microemulsion A).

The resulting microemulsion contained 35 wt% nonvolatiles (2 g, 110° C., 30 minutes) and had a transmittance of 65% at 580 nanometers. Its average particle size, as measured using a Quasi-Elastic Light Scattering Model M2000 (Marler, United States) was 0.06 micrometers.

Water, 495 parts, was added to 30 parts of this microemulsion to obtain a silicone concentration of 2 wt%. A 400 mL portion of this was taken and placed in a 20 cm×35 cm×3 cm rectangular stainless steel vat. A vertical stack of two rubber rolls (diameter=6 cm, nip pressure=0.5 kg/cm2) was installed so that the lower roll was immersed to a depth of 0.5 cm in the emulsion, and the rolls were then rotated at 20 rpm for 8 hours in order to examine the mechanical stability of the emulsion. A 25 mL portion of the microemulsion thus treated with the rolls was then taken and subjected to centrifugal separation at 2,500 rpm for 30 minutes, and the external appearance of the emulsion was then inspected.

Microemulsion A, in this case not subjected to any prior testing, was also diluted with water to a silicone concentration of 5 wt%, and 500 mL of this were then placed in a household mixer and processed at 4,000 rpm for 60 minutes. The status of the emulsion was inspected after this processing. Mixer-processed emulsion was then sprayed on nylon taffeta (dyed beige) using a simple air sprayer, followed by drying at room temperature and then heating at 150° C. for 3 minutes. The fabric thus treated was evaluated for oil spotting and its handle was evaluated by touch.

These results are reported in Table 1.

COMPARISON EXAMPLE 1

Two hundred parts organopolysiloxane with a viscosity of 1,850 centistokes and having the formula $$Me_3SiO(\underset{\underset{C_{10}H_{21}COOH}{|}}{MeSiO})_8(ME_2SiO)_{400}SiMe_3$$

15.0 parts polyoxyethylene (6 mol EO) trimethylnonanol ether, 8.0 parts polyoxyethylene (7 mol EO) octylphenol ether, and 20.0 parts water were combined and stirred to homogeneity. This was then passed once through a colloid mill across a gap of 0.02 inches. Water, 757.0 parts, was then added, with dissolution and dispersion to homogeneity, to afford an emulsion (Emulsion B) having an average particle size of 1.30 micrometers and a transmittance at 580 nanometers of 0%.

Emulsion B was subjected to testing as in Example 1, and these results are also reported in Table 1.

TABLE 1

| Property | Examples 1 & 2 | Comparison Example 1 |
|---|---|---|
| Oil adhesion on rubber roll | Absolutely none | Oil adhesion on part of roll, crawling |
| Emulsion after centrifugation | Homogeneous, no oil flotation | Surface sheen, oil flotation noted |
| Emulsion after mixer processing | Stable, no oil adhesion to walls or blades of mixer | Slight oil adhesion to blades and glass walls of mixer |
| Oil spots on treated fabric | Absolutely none | Slight oil spotting |
| Handle of treated fabric | Very good, not slick, good rebound | Very good, not slick, also good rebound |

EXAMPLE 2

Twenty parts organopolysiloxane with a viscosity of 18,530 centistokes and having the formula $$Me_3SiO(\underset{\underset{C_{10}H_{21}COOH}{|}}{MeSiO})_{20}(ME_2SiO)_{900}SiMe_3$$

2 parts polyoxyethylene (10 mol EO) trimethylnonanol ether, 6 parts nonionic surfactant having the formula $$CH_3(CH_2)_6\underset{\underset{O(C_2H_4O)_5H}{|}}{CH}(CH_2)_3CH_3$$

and 0.5 parts anionic surfactant in the form of the sodium salt of the sulfate ester of polyoxyethylene (5 mol EO) octylphenol ether were stirred to homogeneity using a propeller stirrer. Water, 4 parts, was then added, followed by stirring at 350 rpm for 10 minutes. Water, 67.5 parts, was then slowly added, and emulsification was carried out by stirring at the same rate as before for 30 minutes.

The product was a slightly white, transparent microemulsion having an average particle size of 0.07 micrometers, a transmittance of 62.0% at 580 nanometers, and a pH of 4.3.

This emulsion was tested as in Example 1, and these results are also reported in Table 1.

EXAMPLE 3

Twenty parts organopolysiloxane with a viscosity of 6,540 centistokes and having the formula $$HOOCC_{10}H_{21}Me_2SiO(\underset{\underset{C_{10}H_{21}COOH}{|}}{MeSiO})_{28}(Me_2SiO)_{600}SiMe_2C_{10}H_{21}COOH$$

1.5 parts polyoxyethylene (6 mol EO) trimethylnonanol ether, 6 parts nonionic surfactant with the formula $$CH_3(CH_2)_6\underset{\underset{O(C_2H_4O)_5H}{|}}{CH}(CH_2)_3CH_3$$

and 0.5 parts anionic surfactant in the form of the sodium salt of the sulfate ester of polyoxyethylene (5 mol EO) nonylphenol ether were mixed to homogeneity using a propeller stirrer. Ten parts water were added to this, followed by stirring at 350 rpm for 10 minutes. Water, 62 parts, was then gradually added, followed by stirring for 30 minutes at the same rate as before for emulsification. The pH was then adjusted to 7.0 using aqueous ammonia.

The product was a slightly white, transparent microemulsion having an averge particle size of 0.07 micrometers and a transmittance of 64.0% at 580 nanometers. Five parts of this emulsion, 10.0 parts aqueous glyoxal resin solution (50 wt%), 1.0 part amine catalyst, and 84.0 parts water were then mixed to homogeneity, followed by standing for 24 hours in order to inspect (visually) the blending stability with respect to glyoxal resin and amine catalyst. No resin or oil flotation was observed, and the blending stability was therefore excellent. A man's shirt, 65 wt% polyester/35 wt% cotton blend, was immersed in this treatment bath for 10 seconds, wrung out on wringer rolls, dried at room temperature, and then heated in an oven at 150 degrees Centigrade for 3 minutes. The resulting finished fabric completely lacked oil spots, and its handle was excellent, without slickness. Thus, this finishing composition was entirely suitable for shirting fabric.

EXAMPLE 4

Twenty parts organopoysiloxane with a viscosity of 19,880 centistokes and having the formula $$Me_3SiO(\underset{\underset{C_2H_4SCH_2COOH}{|}}{MeSiO})_{25}(ME_2SiO)_{900}SiMe_3$$

were stirred at 350 rpm for 10 minutes using a propeller stirrer with 3 parts polyoxyethylene (10 mol EO) trimethylnonanol ether and 7 parts of the nonionic surfactant with the following formula.

$$CH_3(CH_2)_6\underset{\underset{O(C_2H_4O)_5H}{|}}{CH}(CH_2)_3CH_3$$

Water, 68 parts, was then slowly added, followed by stirring at the same rate as above for 30 minutes to carry out emulsification. Two parts triethanolamine were then added with stirring for 10 minutes to adjust the pH to 7.5.

The product was a colorless, transparent microemulsion (Microemulsion C) having an average particle size of 0.07 micrometers and a transmittance of 65.0% at 580 nanometers.

This microemulsion was diluted with water to a silicone concentration of 2 wt% and applied at 1.5 wt% add-on as silicone fraction to 100 wt% wool yarn for handknitting, followed by drying at room temperature and then heating at 130° C. for 5 minutes.

No oil flotation occurred in the diluted treatment solution. The smoothness, rebound, softness, and handknittability of the treated wool were sensorially evaluated, and these results are reported in Table 2.

The following microemulsion was prepared for comparison and was similarly evaluated.

Twenty parts organopolysiloxane with a viscosity of 235 centistokes and having the formula $$Me_3SiO(\underset{\underset{C_2H_4SCH_2COOH}{|}}{MeSiO})_3(ME_2SiO)_{97}SiMe_3$$

were stirred for 10 minutes at 350 rpm using a propeller stirrer with 2.5 parts polyoxyethylene (10 mol EO) trimethylnonanol ether and 6 parts nonionic surfactant with the following formula.

$$CH_3(CH_2)_6\underset{\underset{O(C_2H_4O)_5H}{|}}{CH}(CH_2)_3CH_3$$

Water, 69.5 parts, was then slowly added, followed by stirring for 30 minutes at the same rate as above to carry out emulsification. Two parts triethanolamine were added with stirring for 10 minutes to adjust the pH to 7.6.

The product was a colorless, transparent microemulsion (Microemulsion D) having an average particle size of 0.05 micrometers and a transmittance of 65.0% at 580 nanometers.

This microemulsion was diluted with water to a silicone concentration of 2 wt% and applied at 1.5 wt% add-on as silicone fraction to 100 wt% wool yarn for handknitting, followed by drying at room temperature and then heating at 130° C. for 5 minutes.

No oil flotation occurred in the diluted treatment solution. The smoothness, rebound, and softness of the treated wool were similarly evaluated, and these results are also reported in Table 2.

TABLE 2

| Property | The Invention | Comparison Example |
|---|---|---|
| Oil spotting on treated fabric | None | None |
| Smoothness | Very good | Not good |
| Rebound | Good | Not Good |
| Softness | Very good | Unsatisfactory |
| Handknittability | Easily knitted | Poor slip, difficult to knit |

That which is claimed is:

1. A fiber-treatment composition comprising a microemulsion of a carboxyl-modified organopolysiloxane having the general formula $$AR_2SiO(R_2SiO)_{x-1}(RASiO)_yR_2SiA$$

wherein R is a monovalent hydrocarbon group, A is R or $R^1COOH$, $R^1$ is a divalent organic group, x=350 to 2,000, y=0 to 200, and x+y=350 to 2,000 and having at least two $R^1COOH$ groups in each molecule, said microemulsion having an averge particle size not larger than 0.15 micrometers and containing a sufficient amount of base wherein the pH of the microemulsion is 6.5 to 9.0.

2. A fiber-treatment composition according to claim 1 wherein the microemulsion has been prepared by the mechanical emulsification of (A) 100 weight parts of a carboxyl-modified organopolysiloxane having the general formula $$AR_2SiO(R_2SiO)_{x-1}(RASiO)_yR_2SiA$$

wherein R is a monovalent hydrocarbon group, A is R or $R^1COOH$, $R^1$ is a divalent organic group, x=350 to 2,000, y=0 to 200, and x+y=350 to 2,000 and having at least two $R^1COOH$ groups in each molecule, in water in the presence of (B) 15 to 60 weight parts nonionic and/or anionic surfactant.

3. A method for treating fiber, said method comprising (a) applying the fiber-treatment composition of claim 1 to the fiber and (b) drying the treated fiber.

4. A method for treating fiber, said method comprising (a) applying the fiber-treatment composition of claim 2 to the fiber and (b) drying the treated fiber.

5. Treated fibers prepared by the method of claim 3.

6. Treated fibers prepared by the method of claim 4.

* * * * *